United States Patent [19]

Bradt

[11] 4,009,534

[45] Mar. 1, 1977

[54] KINETIC SCULPTURE

[76] Inventor: Gordon E. Bradt, Kinetico Center, Busch, Ark. 72620

[22] Filed: Dec. 17, 1975

[21] Appl. No.: 641,616

[52] U.S. Cl. ..... 40/106.3; 46/148; 40/139

[51] Int. Cl.[2] ..... G09F 19/08

[58] Field of Search ..... 46/148, 245, 264; 40/139, 30, 106.3; 272/31 R

[56] References Cited

UNITED STATES PATENTS

| | | | |
|---|---|---|---|
| 1,587,459 | 6/1926 | Workman | 46/148 |
| 2,960,796 | 11/1960 | Woodrey | 46/148 X |
| 3,029,552 | 4/1962 | Katz | 40/106.3 X |
| 3,888,030 | 6/1975 | Bradt | 40/139 X |

*Primary Examiner*—Hugh R. Chamblee
*Assistant Examiner*—Wenceslao J. Contreras
*Attorney, Agent, or Firm*—Coffee and Sweeney

[57] ABSTRACT

A kinetic sculpture having a generally tubular motion imparting device rotatably mounted on a base structure. The tubular device includes a substantially open, generally irregular top and is rotated by a motor mounted on the base structure about its major longitudinal axis. An object such as a figure toy or the like is releasably rotatably connected to the tubular device and upstands generally upwardly therefrom. The releasable connection includes a spring biased member which rotates with the tubular device through a predetermined arc of revolution from where it is returned to its initial position by a biasing spring. The biasing spring is mounted on the base in engagement with an offset arm extending generally radially from the rotational axis of the object to constantly urge the object in a direction of rotation opposite the rotation of the drive tube. The object may be in the form of a suitable figure toy such as a tennis player or golfer for making repeated swings of a tennis racquet or golf club, respectively. A cantilevered ball is positioned in the path of travel of the tennis racquet or golf club for repeated striking by the respective racquet or club as the drive tube continues to rotate.

16 Claims, 8 Drawing Figures

FIG. 1
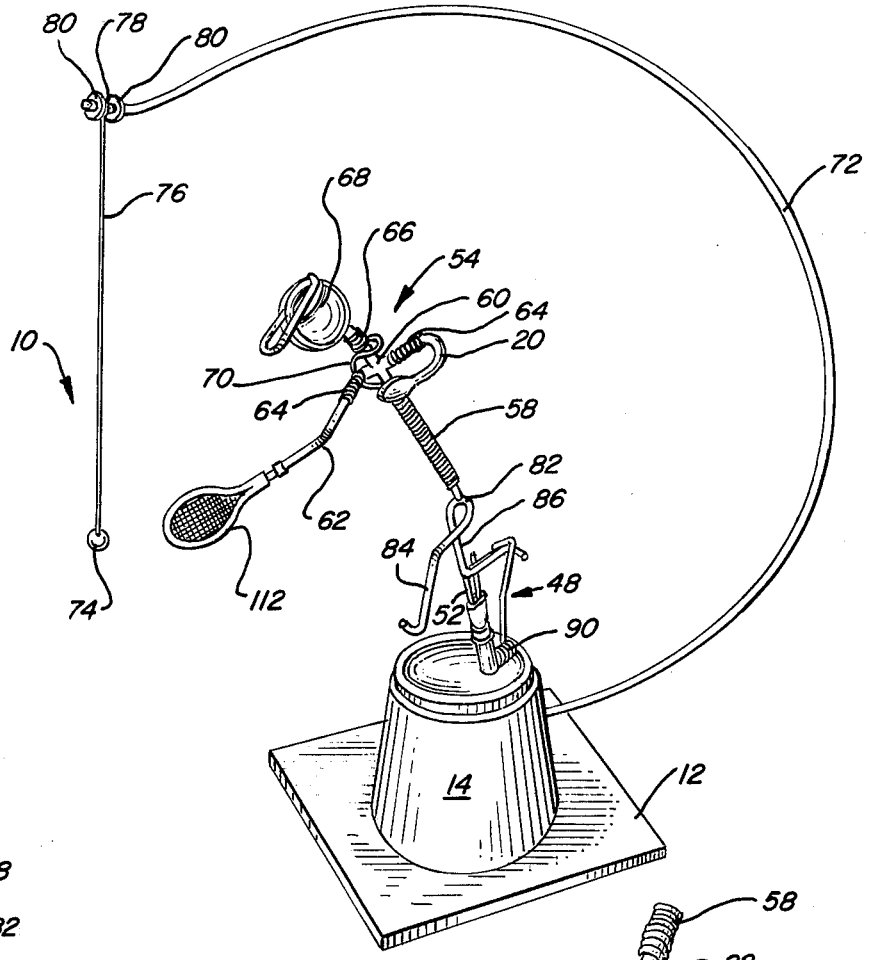
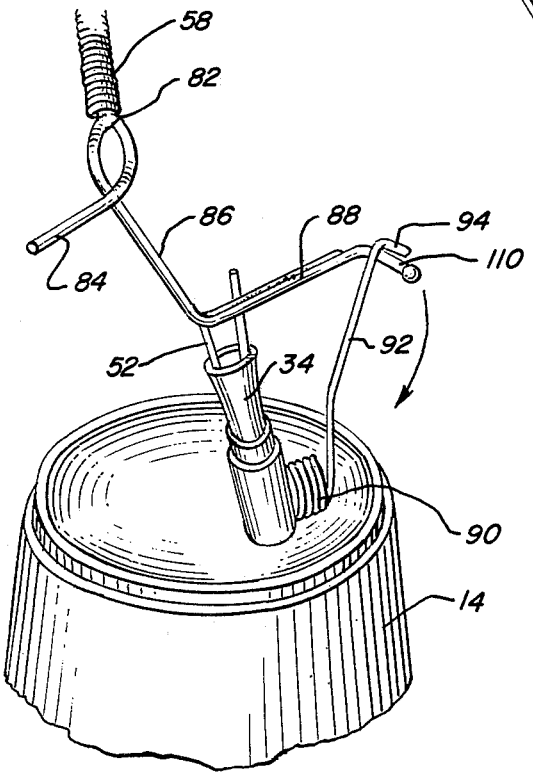
FIG. 2
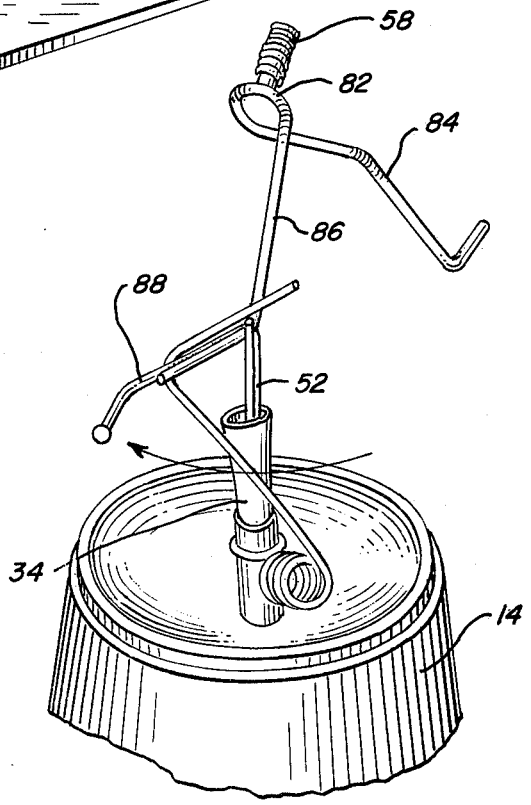
FIG. 3

KINETIC SCULPTURE

BACKGROUND AND SUMMARY OF THE INVENTION

This invention relates to the art of kinetic sculpture and in particular to an improved sculpture of this type.

One of the objects of the present invention is to provide the device of the character described in the form of an action display mechanism providing a simple, low cost and reliable mechanism that imparts a variety of swinging movements to various kinetic art or figure toys when they are mounted on or attached to the device. More particularly, the exemplary embodiment of the present invention includes a generally tubular motion imparting deive rotatably mounted on a base structure. The tubular device includes a substantially open, generally irregular top and is rotated by a motor mounted on the base structure about its major longitudinal axis. An object such as a figure toy or the like is releasably rotatably connected to the tubular device and upstands generally upwardly therefrom. The releasable connection includes a spring biased member which rotates with the tubular device through a predetermined arc of revolution from where it is returned to its initial position by a biasing spring. The biasing spring is mounted on the base in engagement with an offset arm extending generally radially from the rotational axis of the object to constantly urge the object in a direction of rotation opposite the rotation of the drive tube. The object may be in the form of a suitable figure toy such as a tennis player or golfer for making repeated swings of a tennis racquet or golf club, respectively. A cantilevered ball is positioned in the path of travel of the tennis racquet or golf club for repeated striking by the respective racquet or club as the drive tube continues to rotate.

BRIEF DESCRIPTION OF THE DRAWINGS

FIG. 1 is a perspective view of a kinetic sculpture made in accordance with the concepts of the present invention;

FIG. 2 is a fragmentary perspective view, on an enlarged scale, of a portion of the drive system of the device as shown in FIG. 1;

FIG. 3 is another fragmentary perspective view, on an enlarged scale, showing another view of the drive system of the device of FIG. 1;

DESCRIPTION OF THE PREFERRED EMBODIMENT

Figure 4:
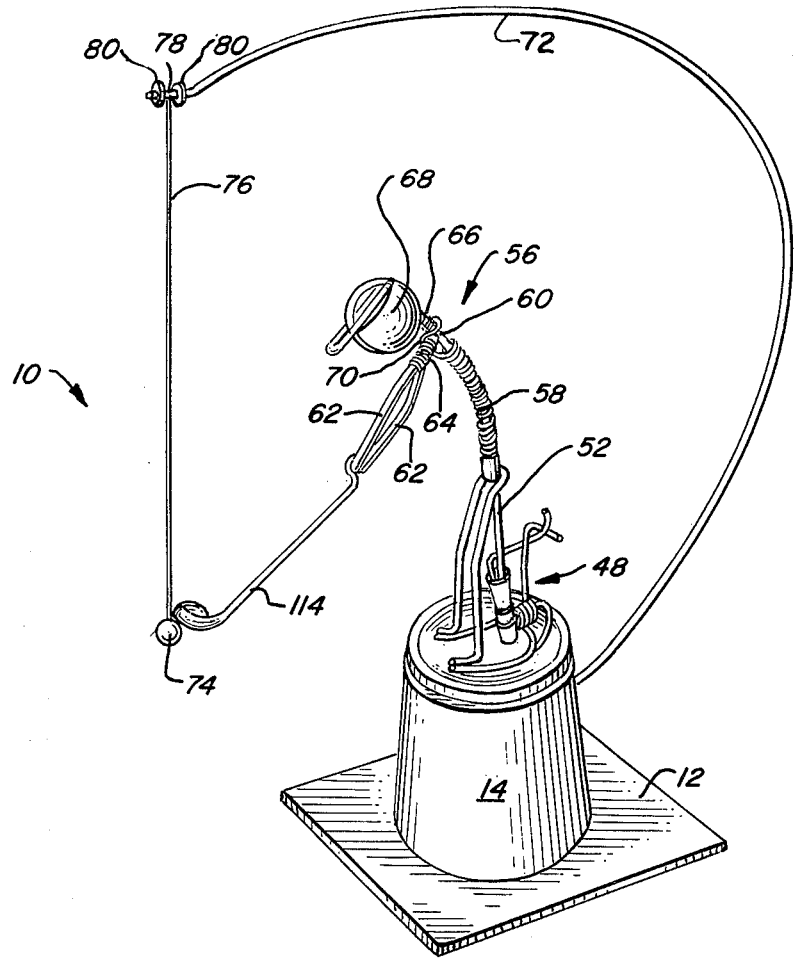
FIG. 4 is a perspective view of an alternate embodiment of a kinetic sculpture made in accordance with the concepts of the present invention.
Figure 6:
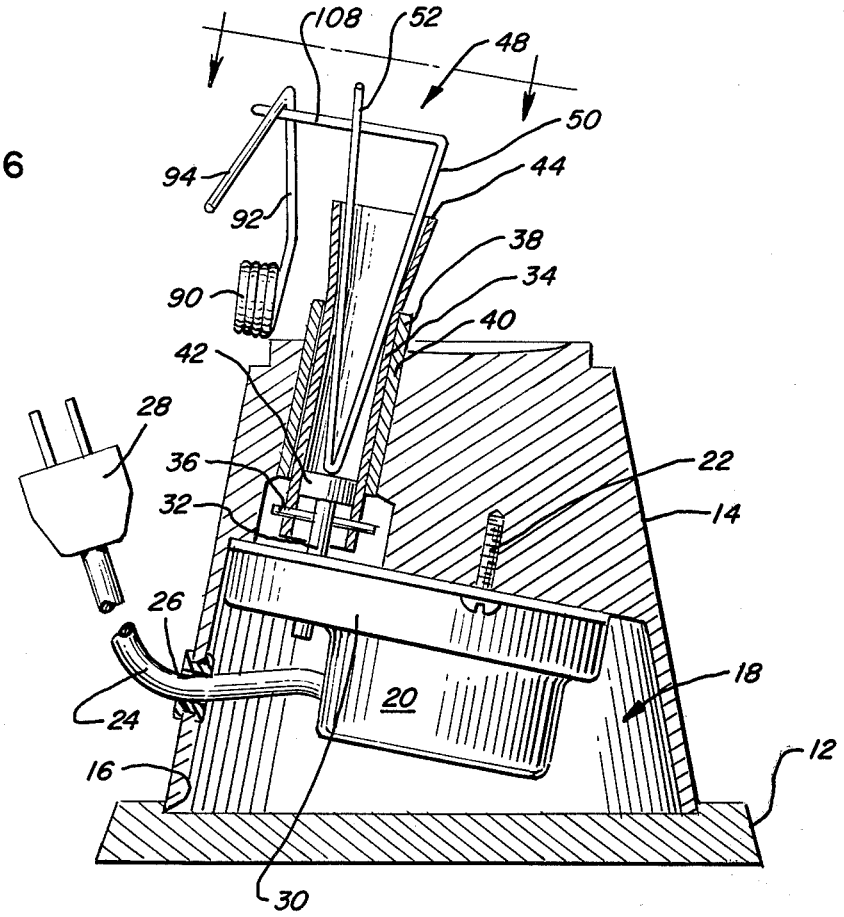
FIG. 6 is a fragmented vertical section through the base of the kinetic sculpture of the present invention with a substantial portion of the figure toy member cut away.

Referring to the drawings in greater detail, and particularly to FIGS. 1, 4 and 6, the kinetic sculpture or action display mechanism of the present invention, generally designated 10, includes a base structure which has a generally flat base portion 12 on top of which is mounted a housing 14. The housing portion 14 is positioned within a recess 16 defined on the top of the flat base portion 12. The housing portion 14 has an internal cavity, generally designated 18. The assembled base is adapted for positioning on a support structure such as a table, desk top, or the like.

An AC motor 20 is mounted within the cavity 18 of the housing 14 by appropriate means such as screws or bolts 22. An appropriate electrical cord 24 leads from the motor 20 through an aperture 26 in the housing portion 14 and has a conventional electrical plug 28 on the outer end thereof for insertion into standard electrical outlets.

The motor 20 has an appropriate step-down gear transmission 30 leading to a drive shaft 32 forming a part of the motive means of the present invention.

The rotatable drive means or motion imparting means of the present invention comprises a tubular member 34 which is operatively associated with the drive shaft 32 so as to be rotated thereby. As seen in FIG. 6, a cross pin 36 fixed to the drive shaft 32 protrudes through appropriate openings in the sides and at the bottom of the tubular member 34 for fixing the tubular member to the drive shaft 32 so as to be rotated thereby. The tubular member 34 is rotatable within a journal or bearing 38 which is fixed relative to the housing portion within a bore 40. The tubular member, thus, is rotatable within the bearing 38 for rotation relative to the housing portion 14.

As best seen in FIG. 6, the tubular member 34 is substantially closed at its bottom end by means of a plug member 42 fixed to the top of the drive shaft 32. The top of the tubular member is substantially open and is defined by a periphery 44 which is irregularly shaped, as will be described in detail hereinafter, to define a cam means.

The two embodiments of the present invention as shown in FIGS. 1 and 4 are releasably engaged within the tubular drive member 34 and similar numbers will be used to identify similar components. The releasable connection means, generally designated 48, includes a V-shaped, hair pin spring 50. The hair pin spring 50 includes an elongated member 52 which extends substantially vertically upwardly from the housing 14. In the embodiment as shown in FIG. 1, the present invention includes a figure toy, generally designated 54, designed to simulate a tennis player. In the embodiment as shown in FIG. 4, the present invention incorporates a figure toy 56 which is designed to simulate a golfer. The figure toys 54 and 56 include a flexibly resilient spring torso 58 which is connected at its uppermost end to a T-member 60. The T-member supports a pair of arms 62 by another similar pair of flexibly resilient spring members 64. A top or neck spring member 66 supports a figure toy head 68. In the specific embodiments shown, the T-member 60 is pivotally secured to the spring torso 58 so that the head and arms can rotate relative thereto about a generally vertical axis. A resilient wire 70 is secured to the torso 58 to limit the rotation of the head and arms to an angle of approximately 180°. In both of the embodiments of FIGS. 1 and 4, a generally arcuately shaped cantilever arm 72 is secured to the base plate 12 to support a ball 74 generally in front of the facing direction of the figure toy. The ball is pivotally supported by a string or tethering wire 76 rotatably connected by an eye 78 to the free end of the arcuate cantilever arm 72. A pair of washers 80 are suitably connected, such as by a press fit, on either side of the tethering wire 76 to limit the movement of the eye 78 along the cantilever arm 72.

In each of the embodiments of FIGS. 1 and 4, while the operation of the kinetic sculpture is identical, the mounting or supporting of each of the figure toys 54 and 56 is slightly different. In FIG. 1, a depending yoke 82 supports one freely movable leg 84 and a second leg 86 which is securely connected, as by welding or the like, to the upwardly directed portion 52 of the hair pin spring 50. An offset crank arm 88 also is connected to the member 52 and extends generally horizontally in a radial direction relative to the axis of rotation of the tubular drive member 34. Biasing means in the form of a coil spring 90 is secured to the housing adjacent the bearing 38. An elongated generally flexible end 92 of the biasing spring 90 extends upwardly into engagement with the arm 88 and includes an offset L-portion 94 which maintains the biasing spring extension 92 in engagement with the arm 88 (FIGS. 2 and 3).

Figure 5:
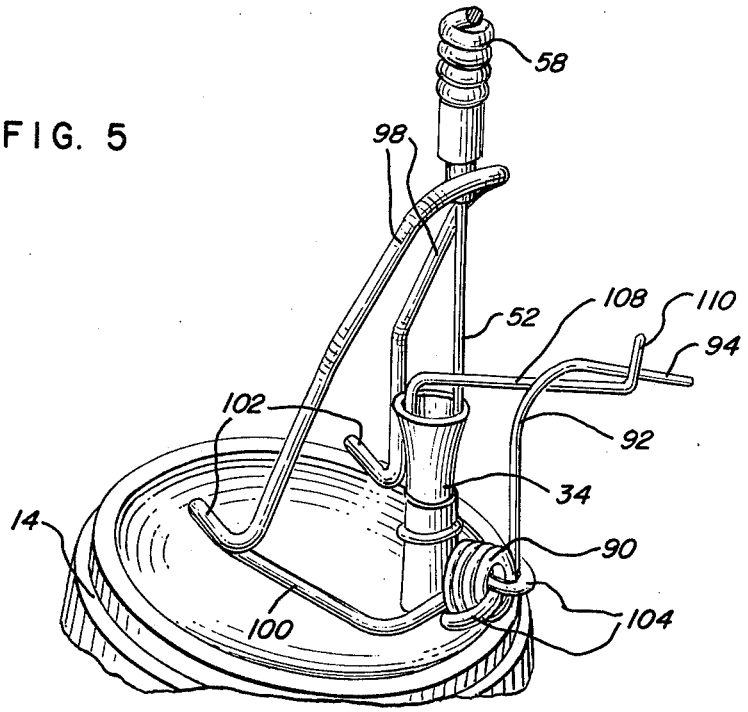
FIG. 5 is a fragmentary perspective view, on an enlarged scale, of the drive system of the device shown in FIG. 4.

Referring to FIGS. 4 and 5, the support of the figure toy 56 is slightly different than that as described above. More particularly, the vertically extending portion 52 of the hair spring 50 is connected directly to the torso spring portion 58 of the "golfer" figure toy. A pair of legs 98 are supported below the torso on the housing 14 by a generally U-shaped wire 100 connected to a pair of feet 102 on the legs 98. The generally U-shaped wire 100 which supports the legs 98 and feet 102 may be loosely attached to the coil spring 90 by a pair of curved or bent ends 104 about the spring 90. Alternatively, the U-shaped wire could be securely fastened to the bearing 38. In this embodiment (FIG. 5), the hair spring 50 includes a horizontal offset arm portion 108 which is directed generally radially and rearwardly from the rotational axis of the rotatable drive tube 34. Again, an upwardly elongated end 92 of the biasing spring 90 engages the arm 108 and is maintained thereon by an L-shaped bend 94 as described above. An appropriate bend or kink 110 at the end of each arm 108 and 88 is provided to assure that the biasing spring extension 92 does not slip off of either arm 88 or 108.

Figure 7:
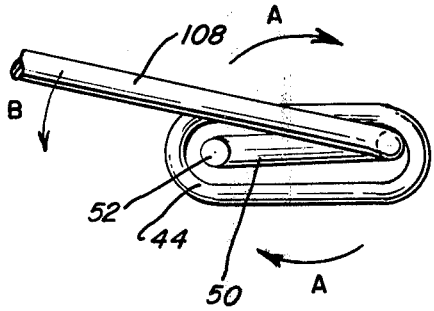
FIG. 7 is a fragmented top plan view of the drive system taken generally along line 7—7 of FIG. 6.
Figure 8:
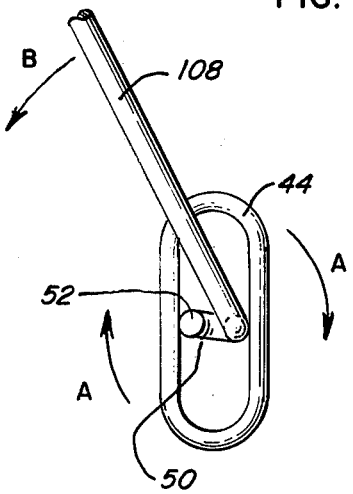
FIG. 8 is a top view similar to FIG. 7, after the drive tube has rotated 90°.

In operation, power is transmitted to the motor 20 which through the drive train 30 causes the drive tube 34 to rotate. Referring to FIGS. 7 and 8, the upper irregularly shaped periphery 44 of the drive tube 34 is flaired or flattened slightly to define a generally elliptical or oval periphery 44. The hair spring 50 may be compressed in order to fit within the internal diameter of the drive tube 34 and when released, tends to seat in its most expanded position, such that the two legs of the V lie generally along the major axis of the ellipse or oval periphery 44 as shown in FIGS. 6 and 7. From this initial position, as the drive tube 34 rotates in the direction of arrow A as shown in FIGS. 7 and 8, the hair spring 50 is caused to rotate therewith. The upstanding arm 52 which supports the figure toy 54 or 56 rotates therewith causing the figure toy 54 or 56 to rotate and thereby giving the appearance of the figure toy taking a back stroke or wind-up prior to striking at the ball 74. During this rotation, the extension 92 of the biasing spring 90 is constantly urging the arm 108 or 88 in a direction opposite that of the rotation of the tube 34 shown by arrow B in FIGS. 7 and 8. This force applied by the extension 92 of the biasing spring 90 causes the hair spring 50 to rotate slightly within the elliptical or oval end 44 of the drive tube 34 which as a consequence, causes the hair spring 50 to be compressed. After approximately 90° of rotation of the drive tube 34, as shown in FIG. 8, the hair spring 50 will be almost totally compressed so that the two legs of the V lie generally on the minor axis of the ellipse or oval periphery 44. At this point, the force of the biasing spring 90 is sufficient to overcome the frictional driving force between the drive tube 34 and the hair spring 50. This point is an over-center point or a release condition for the releasable connection means 48 and the force of the biasing spring 90 quickly returns the radial arm 108 or 88 back to its initial position. Simultaneously, since the hair spring 50 has reached its over-center position, the hair spring expands thus causing additional momentum to be applied to the figure toy which comprises the forward or striking stroke of the figure toy 54 or 56. The hair spring 50 will then again seat along the major axis of the periphery 44 at a position where the tube 34 has rotated 180° with respect to the housing 14. This quick return gives the figure toy 54 or 56 the actual appearance of a power stroke. As can be seen with reference to FIGS. 7 and 8, each time the figure toy rotates under the force of the biasing spring 90, it will swing through an arc greater than 90° since during its quick recoil, the drive tube 34 has not yet rotated to its initial position as shown in FIG. 7. Continued rotation of the drive tube 34 causes the figure toys 54 or 56 to make continued back strokes and quick forward strokes for approximately each 180° rotation of the drive tube 34. The specific angles as described above may be varied depending upon the resilience of the hair spring 50 and biasing spring 90.

The figure toy 54 is designed to be a tennis player and a tennis racquet 112 is securely fastened to the end of one arm 62. As the figure toy 54 rotates, the weight of the head 68 and racquet 112 will cause the figure toy to flex outwardly slightly so that the racquet 112 will travel through an interference path with the ball 74 thus striking the ball on each stroke. Similarly, the golfing figure toy 56 includes a golf club 114 secured to the ends of both hands 62 such that the end of the club 64 will strike the ball 74 during each stroke. The cantilever arms 72 are manufactured of flexible wire or the like and can be permanently bent slightly in order to properly align the tethered ball 74 in the path of travel of the tennis racquet 112 or golf club 114.

The foregoing detailed description has been given for clearness of understanding only and no unnecessary limitations should be understood therefrom as some modifications will be obvious to those skilled in the art.

I claim:

1. A kinetic sculpture, comprising:

a base adapted for positioning on a support surface, such as a table or the like;

a rotatable drive means mounted on said base;

an outwardly extending object mounted on said base and operatively connected with said drive means for rotation thereby in a given direction;

releasable connection means between said object and said drive means for releasing the driving force therebetween at a predetermined point of rotation of said object;

biasing means between said base and said object for returning the object to an initial point of rotation whereby continuous operation of said drive means effects oscillating movement of said object; and said rotatable drive means including a rotatable tubular drive member having a substantially open irregularly shaped periphery defining a portion of the releasable connection means.

2. The kinetic sculpture of claim 1 wherein said biasing means biases said object into engagement with the irregularly shaped periphery of the tubular drive member.

3. The kinetic sculpture of claim 2 wherein said biasing means comprises an offset arm protruding generally at right angles from the object and a spring mounted on the base structure in engagement with said arm for constantly urging the object to rotate in a direction opposite the direction of rotation of the tubular drive member.

4. The kinetic sculpture of claim 3 wherein said releasable connection means comprises a generally V-shaped hair spring receivable in the open end of said drive tube to move the object with the rotatable tube to said predetermined point of rotation thereof where the co-action between the biasing means and the hair spring causes the hair spring to flex to a generally closed position to permit the biasing means to rotate the object and hair spring relative to the rotatable drive tube back to its initial position.

5. The kinetic sculpture of claim 4 wherein the irregular periphery of the rotatable tubular drive member is in the shape of an oval so that the hair spring engages the peripheral surface of the oval along the major axis of the oval when in its initial position and engages the peripheral edges of the oval along its minor axis when in the release position.

6. A kinetic sculpture, comprising:

a base adapted for positioning on a support surface, such as a table or the like;

a rotatable drive means mounted on said base;

an outwardly extending object mounted on said base and operatively connected with said drive means for rotation thereby in a given direction;

releasable connection means between said object and said drive means for releasing the driving force therebetween at a predetermined point of rotation of said object;

biasing means between said base and said object of returning the object to an initial point of rotation whereby continuous operation of said drive means effects oscillating movement of said object; and said object being in the shape of a figure which includes at least one biased extremity which is caused to pivot through a predetermined path and return as the drive means rotates through an arc of approximately 180°.

7. The kinetic sculpture of claim 6 including a cantilever arm mounted to the base and a ball supported by the cantilever arm in a generally interference path with the pivotal extremity of the figure object so that as the drive means rotates the extremity of the figure the extremity will attempt to strike the ball.

8. The kinetic sculpture of claim 7 including an article secured to the end of the extremity of the figure to facilitate striking of the ball.

9. The kinetic sculpture of claim 8 wherein said article is a simulated tennis racquet.

10. The kinetic sculpture of claim 8 wherein said article is a simulated golf club.

11. A kinetic sculpture, comprising: a base adapted for positioning on a support surface, such as a table or the like, a rotatable drive means mounted on said base and including a rotatable tubular drive member having a substantially open irregularly shaped periphery, an outwardly extending object mounted on said base and operatively connected with said drive means for rotation thereby in a given direction, releasable connection means between said object and said drive means for releasing the driving force therebetween at a predetermined point of rotation of said object, biasing means between said base and said object for returning the object to an initial point of rotation whereby continuous operation of said drive means effects oscillating movement of said object, and said releasable connection means comprising a generally V-shaped hair spring receivable in the open end of said drive tube to move the object with the rotatable tube to said predetermined point of rotation thereof where the co-action between the biasing means and the hair spring causes the hair spring to flex to a generally closed position to permit the biasing means to rotate the object and hair spring relative to the rotatable drive tube back to its initial position.

12. The kinetic sculpture of claim 11 wherein the irregular periphery of the rotatable tubular drive member is in the shape of an oval so that the hair spring engages the peripheral surface of the oval along the major axis of the oval when in its initial position and engages the peripheral edges of the oval along its minor axis when in the release position.

13. A kinetic sculpture, comprising:

a base adapted for positioning on a support surface such as a table or the like;

a rotatable drive means mounted on said base;

on outwardly extending object mounted on said base and operatively connected with said drive means for rotation thereby in a given direction, said object being in the shape of a figure which includes at least one extremity which is caused to pivot through a predetermined path and return as the drive means rotates;

releasable connection means between said figure object and said drive means for releasing the driving force therebetween at a predetermined point of rotation of said figure object;

biasing means between said base and said figure object for returning the figure object to an initial point of rotation whereby continuous operation of said drive means effects oscillating movement of said figure object; and a cantilever arm mounted to the base and a playing piece supported by the cantilever arm in a generally interference path with the pivotal extremity of the figure object so that as the drive means rotates the extremity of the figure object the extremity will attempt to strike the playing piece.

14. The kinetic sculpture of claim 13 wherein said extremity of the figure object comprises an athletic implement and said playing piece comprises a ball.

15. The kinetic sculpture of claim 13 wherein said cantilever arm is generally arcuately shaped and connected to said base generally behind the normal frontal facing direction of the figure object with the cantilever arm arcing over the top of the figure to support said playing piece generally in front of the facing direction of the figure object.

16. The kinetic sculpture of claim 13 including a free hanging supporting tethering member connected between the end of said cantilever arm and said playing piece.

* * * * *